US007259776B2

(12) United States Patent
Huegle

(10) Patent No.: US 7,259,776 B2
(45) Date of Patent: Aug. 21, 2007

(54) TACHOGRAPH WITH CUBIC HOUSING AND PRINTING DEVICE

(75) Inventor: Axel Huegle, Furtwangen (DE)

(73) Assignee: Siemens AG, München (DE)

( * ) Notice: Subject to any disclaimer, the term of this patent is extended or adjusted under 35 U.S.C. 154(b) by 357 days.

(21) Appl. No.: 10/947,277

(22) Filed: Sep. 23, 2004

(65) Prior Publication Data

US 2005/0057634 A1 Mar. 17, 2005

Related U.S. Application Data

(63) Continuation of application No. PCT/DE03/00983, filed on Mar. 25, 2003.

(30) Foreign Application Priority Data

Apr. 5, 2002 (DE) ..... 102 15 122

(51) Int. Cl.
*B41J 2/325* (2006.01)
*G01D 15/10* (2006.01)

(52) U.S. Cl. ..... 347/222; 347/108

(58) Field of Classification Search ..... 347/222, 347/108, 138, 152, 170; 400/691
See application file for complete search history.

(56) References Cited

U.S. PATENT DOCUMENTS 4,644,368 A * 2/1987 Mutz ..... 346/33 D
5,020,926 A * 6/1991 Wilhelm ..... 400/54
5,447,380 A * 9/1995 Colonel et al. ..... 400/120.01
5,791,796 A * 8/1998 Gustavsson et al. ..... 400/693
6,361,231 B1 * 3/2002 Sato et al. ..... 400/621
6,392,677 B1 * 5/2002 Lais ..... 346/33 D
6,414,704 B1 * 7/2002 Yamashita ..... 347/222
6,439,903 B1 * 8/2002 Burkart ..... 439/159
6,469,726 B2 * 10/2002 Sekiya ..... 347/222

(Continued)

FOREIGN PATENT DOCUMENTS

DE 40 25 155 A1 5/1991

(Continued)

OTHER PUBLICATIONS

Derwent Abstract—DE-29920901U1;Feb. 17, 2000; Mannesmann VDO AG, D-60388 Frankfurt (Germany).

(Continued)

*Primary Examiner*—Stephen Meier
*Assistant Examiner*—Leonard Liang

(57) ABSTRACT

A tachograph has a cubic housing and a printing device having a thermal print head, a feed roller driven by a drive mechanism and a carrier movable out of the housing to reload a ribbon which forms a stock of printing material. Locking means lock and unlock the carrier in a closed position in the housing. A latch element is mounted rotatably on the carrier and subjected to an action of a tension spring. A snap-in hook of the latch element is associated with a snap-in member in a fixed position. An actuating arm is formed with the latch element, and a pushbutton is configured to be in operative connection with the actuating arm and mounted displaceably on the carrier. A fixed stop associated with the actuating arm disengages the latch element from the snap-in member when the pushbutton is actuated, and displaces the carrier in a direction of an insertion position when the actuating arm is supported on the stop.

10 Claims, 4 Drawing Sheets

U.S. PATENT DOCUMENTS 6,494,632 B2 * 12/2002 Cappello et al. ..... 400/624

FOREIGN PATENT DOCUMENTS

| | | | | |
|---|---|---|---|---|
| DE | 692 02 755 | T2 | | 2/1996 |
| DE | 196 22 376 | A1 | | 12/1996 |
| DE | 297 20 521 | U1 | | 6/1998 |
| DE | 299 20 901 | U1 | | 2/2000 |
| DE | 201 01 836 | U1 | | 5/2001 |
| EP | 918222 | A1 | * | 5/1999 |
| JP | 08115448 | A | * | 5/1996 |
| JP | 08161569 | A | * | 6/1996 |
| JP | 11283064 | A | * | 10/1999 |
| WO | WO9810380 | A1 | * | 3/1998 |

OTHER PUBLICATIONS

Derwent-Abstract—DE-19622376A1;Dec. 19, 1996; Samsung Electronics Co. Ltd., KR-Kyungki-do (Korea).
Derwent-Abstract—DE-69202755T2;Feb. 15, 1996; Pioneer Electronic Corp., JP-Tokyo (Japan).
Derwent-Abstract—DE-4025155A1; May 16, 1991; Wangtek, US-Simi Valley, California (USA).
Derwent-Abstract—DE-20101836U1; May 10, 2001; Mannesmann VDO AG, D-60388 Frankfurt (Germany).
Derwent-Abstract—DE-29720521U1; Jun. 25, 1998; Mannesmann VDO AG, D-60388 Frankfurt (Germany).

* cited by examiner

TACHOGRAPH WITH CUBIC HOUSING AND PRINTING DEVICE

CROSS-REFERENCE TO RELATED APPLICATIONS

The present application is a continuation of international application number PCT/DE03/00983, filed on Mar. 25, 2003, which designates the United States of America, and further claims priority of German patent application number DE 10215122.9, filed on Apr. 5, 2002, the both of which are herein incorporated by reference.

BACKGROUND OF THE INVENTION

The invention relates to a tachograph having a cubic housing and a printing device, which has a thermal print head, a feed roller which is driven by a drive mechanism, and a carrier which can be moved out of the housing and is used for reloading a ribbon which forms the stock of printing material, and further having means for locking and unlocking the carrier in its closed position in the housing of the tachograph.

Tachographs which are not designed for the use of record charts as recording media, but rather in which the driving and working time data determined are stored in suitably designed bulk memories, require suitable printing devices for documentation in the form of a visually readable document. These devices have to be arranged inside the tachographs since there is generally not enough space in a driver's cab of a commercial vehicle for the installation of an independent printer which corresponds with the tachograph. If a tachograph of this type is equipped with a printing device which, contrary to the use of plug-in, card-like printing substrates, envisages a printing principle with strip-like or ribbon-like printing material, it is necessary for the printing device in question to be loaded with the stock of printing material and for the starting section of the printing material to be moved into the printing position.

One problem is, however, that tachographs are generally designed as built-in appliances and are therefore fitted with a flush front wall so that access for reloading the stock of printing material is only possible from the front side using a carrier which can be displaced in the manner of a drawer or can be pivoted open/folded open on the front side. In this case, in the area in which a tachograph is used, in which considerable vibration and shock loads occur, the locking and unlocking means assigned to the carrier are of crucial importance.

DE-U 29720521 discloses a tachograph, in which a drawer-like carrier is provided for holding the entire printing device and is assigned a bistable snap-in mechanism. In the event of printing material having to be refilled, the carrier is unlocked by actuation of the front panel of the carrier, which panel serves as a pushbutton, and, when the front panel is released, is displaced into the insertion position. Apart from the outlay and an unreliable performance in respect of security against shocks because of the not inconsiderable mass of the carrier, the bistable snap-in mechanism requires the carrier to be able to be moved in the locked state, in the direction of the rear wall of the housing of the tachograph, which makes sealing of the front panel with respect to the front wall of the tachograph considerably more difficult in the locked state of the carrier.

The same applies to a printing device described in DE-U 29920901, in which a thermal print head is arranged in a fixed position in the housing of the tachograph and the feed roller mounted in the carrier has to be brought into operative connection again with the thermal print head when the carrier is closed after each insertion of a ribbon. In such a printing device, the relatively high press-on force of the thermal print head obstructs the ability of the carrier to move, and so the snap-in mechanism has to be equipped with an extremely strong ejection spring or the carrier has to be pulled out by hand after being unlocked, which, apart from being disadvantageous to handle, requires esthetically unfavorable gripping means to be provided on the front panel of the carrier.

SUMMARY OF THE INVENTION

An object of the present invention is to provide for a printing device of the generic type used in a tachograph having functionally reliable locking means which can be handled in a simple manner in respect of being unlocked and which meet the requirements of mass production by means of simple components which can easily be fitted.

In one embodiment, the invention provides for at least one latch element which is subjected to the action of a spring to be provided, for the latch element to be mounted rotatably on the carrier, for a snap-in hook of the latch element to be assigned a snap-in member in a fixed position, for an actuating arm to be formed integrally with the latch element, for a pushbutton which can be brought into operative connection with the actuating arm to be mounted displaceably on the carrier, and for a positionally fixed stop which is assigned to the actuating arm to be provided in such a manner that, when the pushbutton is actuated, the latch element is disengaged from the snap-in member and, by the actuating arm being supported on the stop, the support is displaced in the direction of the insertion position.

One advantageous development of the invention is that latch elements are provided on both sides of the carrier, and that the latch elements are fastened on a shaft which is mounted in the carrier, that a pin is fastened to the actuating arm, that the pushbutton is provided with a sloping plane which is assigned to the pin, that at least one latch element is assigned a switch indicating the closed position of the carrier, and that a spring-mounted push-in member which preferably interacts with the rear wall of the tachograph is arranged on the carrier.

A preferred exemplary embodiment of the invention makes provision, in conjunction with a printing device, in which the thermal print head which is subjected to the action of a spring is mounted pivotably in a bearing bridge fastened to the cover plate of the housing of the tachograph and the feed roller and the drive mechanism are assigned to the carrier, with, in the closed position of the carrier, the feed roller being supported under the thermal print head, which rests resiliently on it, on retaining arms formed the bearing bridge, that the snap-in members assigned to the latch elements, and stops are arranged or formed on the limbs of the bearing bridge.

The preferred exemplary embodiment can furthermore be developed by the fact that the bearing bushings of the feed roller, which bushings are arranged in the framework of the drive mechanism, are assigned wedge surfaces and snap-in lugs formed on the retaining arms, and in that the guide of the carrier has a play corresponding to the travel of the snap-in lugs.

It is also conceivable that, in the case of a printing device according to the preferred exemplary embodiment, holders are formed for the bearing bushings of the feed roller in the bearing bridge in such a manner that, in interaction with the thermal print head resting resiliently on the feed roller, a play-free snap-in connection is provided for the feed roller and therefore for the carrier, and the latch elements are not absolutely necessary. This means that only the unlocking means have to be provided in order, when the pushbutton is actuated, to lift the bearing bushings out of the holders and to displace the carrier in the direction of the insertion position, with a push-in device which is provided in the rear space of the carrier displacing the carrier into a gripping position after the pushbutton is released. If a push-in device is not provided, then the unlocked carrier can be pulled out of the tachograph into the insertion position by means of gripping means formed in a suitable manner on the front panel.

Further advantageous refinements of the invention emerge from the following description and the attached drawings. Apart from the fact that it achieves the set object in a satisfactory manner, the invention provides the advantage of being able to be used both in a structural concept, in which the entire printing device is assigned to the carrier, in which case suitable measures for forming the stops and snap-in members have to be taken in the housing of the tachograph in question, and also in the preferred exemplary embodiment which envisages the thermal print head and feed roller being separated in the event of a ribbon being reloaded. Furthermore, in the case of the preferred exemplary embodiment, the latch elements are used for exactly aligning the feed roller with the thermal element strip.

The invention provides a particular effect by virtue of the fact that, when the carrier is locked by means of the pushbutton mounted in the front panel, the latch elements are pivoted and then, by the actuating arms being supported on the stops, a deflection of force causes the carrier to be displaced in the direction of the insertion position, so that, on the one hand, when the pushbutton is released, re-locking is prevented and, on the other hand, the frictional connection between the thermal print head and the feed roller is released, if appropriate with a pressure point caused by snap-in lugs being overcome. In this case, the actuation of the pushbutton by hand and the pivoting of the latch elements over a sloping plane permit a relatively strong tension spring which acts on the latch elements, and therefore enable a sufficiently high security against shocks.

It is furthermore advantageous that, after the carrier is unlocked and after the pushbutton is released, the push-in device assigned to the carrier is used to displace the carrier into a gripping position. In this case, the compression spring assigned to the push-in device is dimensioned in such a manner that it overcomes at least the friction of the carrier in its guide and therefore only an insignificant amount of force is required in addition to the effort necessary during the closing of the carrier to pivot the latch elements and raise the thermal print head when bringing the feed carrier into the printing position. The closed position of the carrier is signaled by means of switches assigned directly to the latch elements.

BRIEF DESCRIPTION OF THE SEVERAL VIEWS OF THE DRAWINGS

The invention will be explained in greater detail below with reference to drawings, in which.

DETAILED DESCRIPTION OF THE INVENTION

Figure 1:
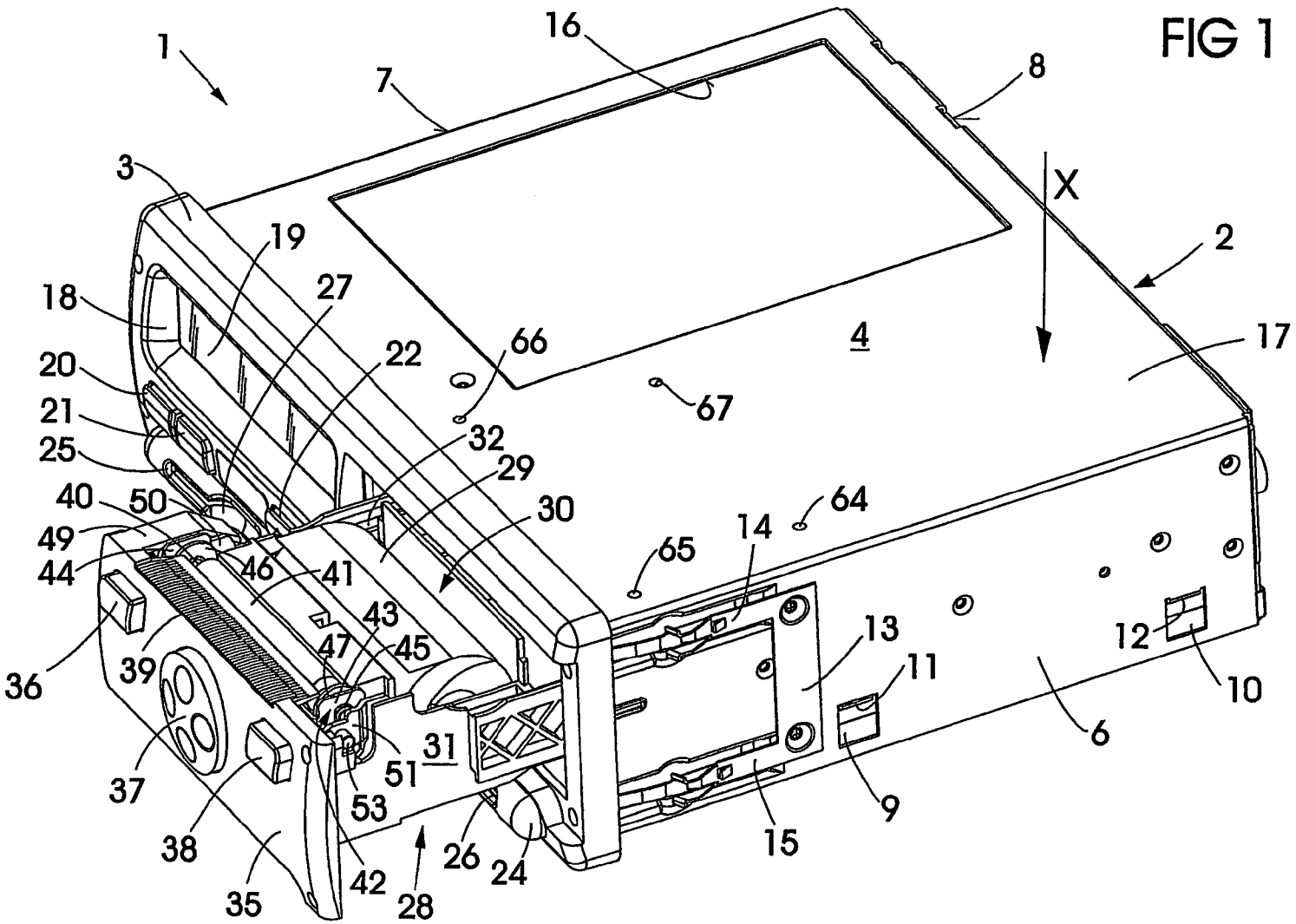
FIG. 1 shows a perspective of a tachograph equipped with a printing device of the generic type.

The tachograph 1 which is illustrated by FIG. 1 has a built-in housing part 2 and a front panel 3 fastened to the latter. The built-in housing part 2 comprises a cover part 4 and a bottom part 5, side walls 6 and 7 and also a rear wall 8 being integrally formed on the cover part 4. Limbs overlapping the side walls 6, 7 and the rear wall 8 are integrally formed on the bottom part 5 and on them latches, two 9 and 10 of which can be seen in FIG. 1, are formed. When the cover part 4 and base part 5 are joined together, said latches can be brought into engagement in a bayonet-like manner with tabs 11 and 12 which are formed on the side walls 6, 7. U-shaped components 13, the limbs of which are designed as resilient claws 14 and 15, are fastened on both side walls 6, 7 for the purpose of fastening the tachograph 1 in a built-in compartment or in a suitable opening, for example in a dashboard. A depression provided in the cover panel 17 for a nameplate is referred to by 16. A window cutout 18 through which the read-out of a display 19 can be read is provided in the front panel 3 in a manner known per se. Furthermore, pushbuttons 20, 21, 22 and 23 which are used, on the one hand, for logging on the driver and passenger and, on the other hand, for releasing personal data cards assigned to the particular driver and front passenger, reach through the front panel 3. Guide slots 25 and 26 which are formed in a bead-shaped projection 24 and are countersunk in a funnel-shaped manner are used for introducing the data cards into the reading/writing assemblies located in the built-in housing part 2. Recesses of the bead-shaped projection 24, one of which is referred to by 27, are used for grip when removing the data cards.

As shown in FIG. 1, the printing device assigned to the tachograph 1 is in a state in which a carrier 28 is located in the insertion position, which is defined by a stop, with regard to the ribbon 29 which is to be reloaded from time to time and forms the stock of printing material. Said ribbon is accommodated in a trough 30 formed in a suitable manner in a carrier 28 which can be displaced in a drawer-like manner in the tachograph 1. Cheeks 31 and 32 integrally formed on this carrier 28 are used for guiding the carrier 28 in guide rails 33 and 34 formed or fitted, on the one hand, on the side wall 6 and, on the other hand, on a stabilizing structural part provided in the built-in housing part 2. A front wall of the carrier 28 is referred to by 35 and is designed in conjunction with an indentation (not referred to specifically), which is also suitable for providing a seal and is in the front panel 3, in such a manner that it is fitted flush into the outer contours of the front panel 3. A pushbutton 36 which is led out of the front wall 35 is used to trigger printing. By means of a rocker switch 37 which is likewise arranged on the carrier 28, different functions and data memories can be selected and, for example in conjunction with the pushbuttons used for logging on the drivers, the working time data of the drivers can be interrogated.

Figure 2:
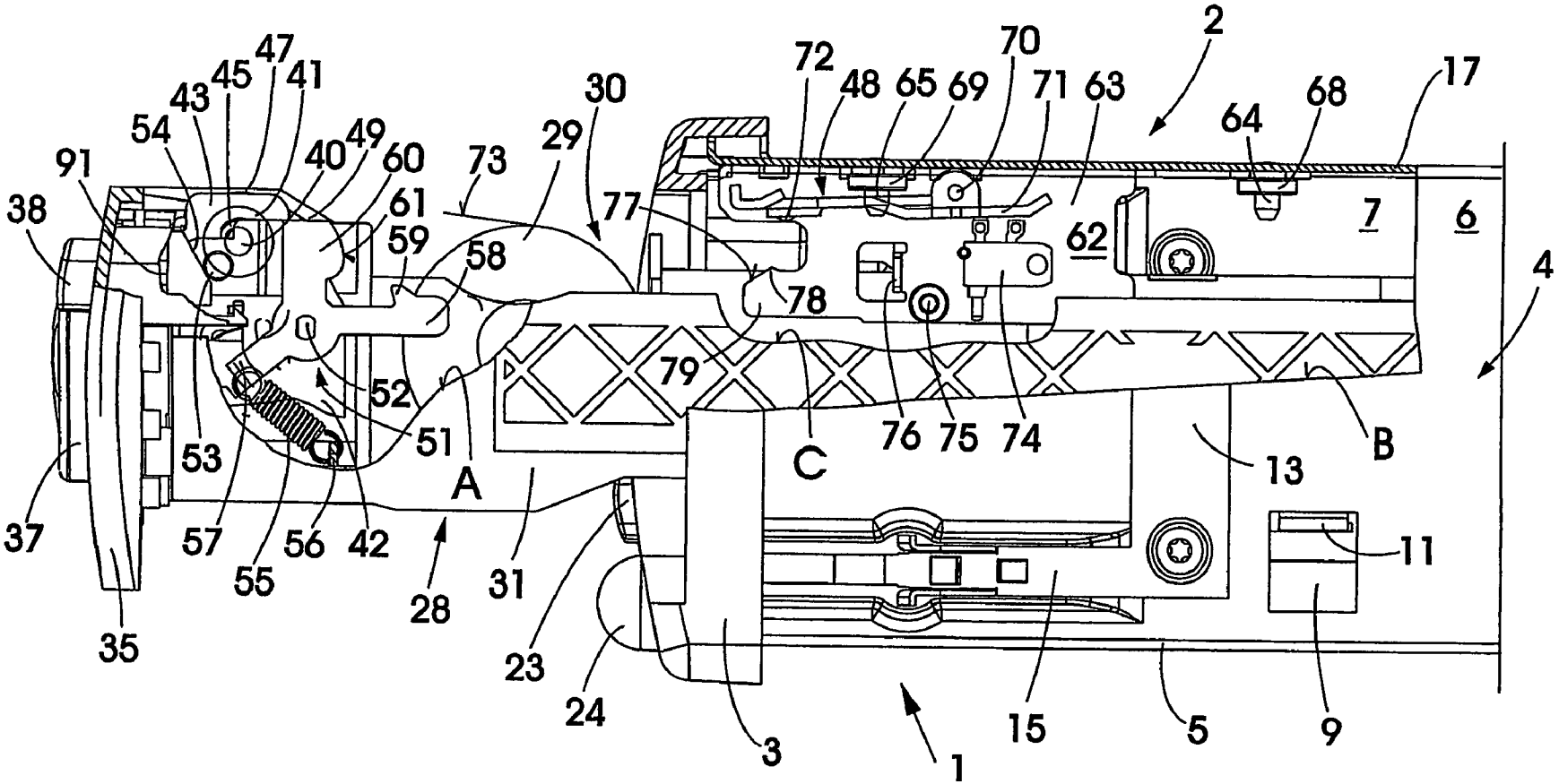
FIG. 2 shows a partial side view of the tachograph according to FIG. 1 provided with cut-open sections, in the insertion position of the carrier.
Figure 3:
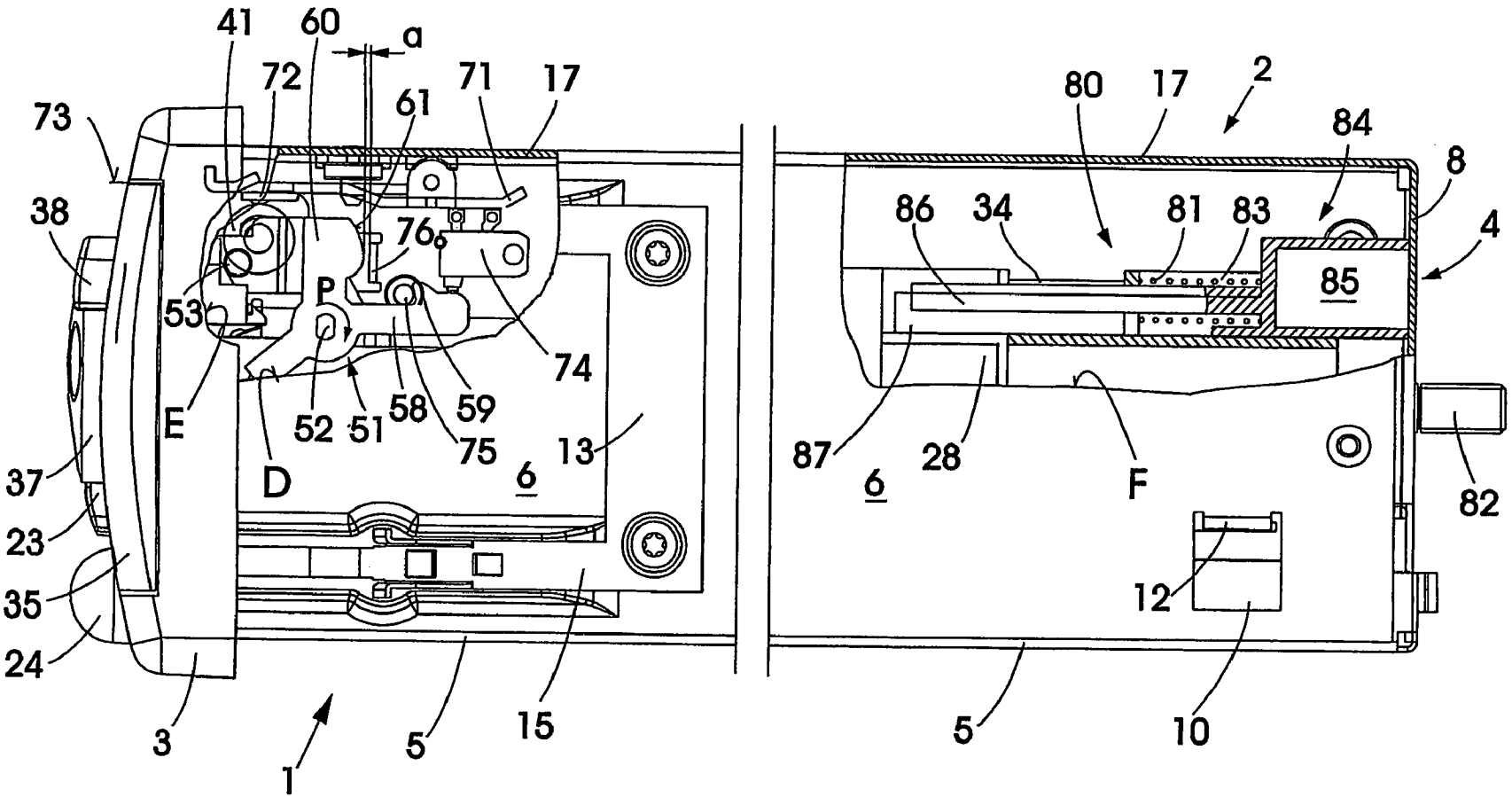
FIG. 3 shows a shortened side view of the tachograph according to FIG. 1, which is provided with cut-open sections, in the closed position of the carrier.

A further pushbutton 38 which is guided in the front wall 35 is used for unlocking the carrier 28 in the event of printing material having to be refilled. A tear-off comb which is formed on the front wall 35 and is used for severing a printed document is referred to by 39. As FIG. 1 shows, an elastomeric feed roller 41 which is connected to a shaft 40 and is used for advancing the printing material is mounted on the carrier 28. That is to say, a framework 42 is fastened on the carrier 28 and bearing bushings, which are assigned to the shaft 40 and one of which is referred to by 45, are secured in the limbs 43 and 44 of said framework. Directing disks 46 and 47 which are formed integrally on the bearing bushings 45 are used for axially aligning the shaft 40 when bringing the feed roller 41 into the printing position with the thermal printing head 48, part of which is illustrated in FIGS. 2 and 3. Furthermore, the framework 42 is used for the mounting of the drive mechanism which drives the shaft 40, i.e., a motor and a gear mechanism which is required between its motor shaft and the shaft 40 and which is assigned a covering 49 integrally formed on the front wall 35. Latch elements which are arranged in a rotationally fixed manner on a shaft 52 mounted in the framework 42 are referred to by 50 and 51 and their function will be explained in greater detail below. A pin which is referred to by 53 and is fastened to the latch element 51 is assigned to the pushbutton 38.

It can be gathered from the partial side view of the tachograph 1 shown in FIG. 2 that the pin 53 interacts with a sloping plane 54 which is formed on the pushbutton 38, which is guided and supported in a suitable manner in the front wall 35. In addition, a cut-open section A in the cheek 31 shows a tension spring 55 which is assigned to the latch elements 50, 51 and is fitted, on the one hand, on a hook 56 fixed on the framework and, on the other hand, on an angled lever 57 of the latch element 51. A latch which is formed in each case on the latch elements 50, 51 and is provided with a snap-in hook 59 is referred to by 58. An actuating arm which is likewise integrally formed on the two latch elements 50, 51 and on which a sliding surface 61 is formed is represented by 60. A cut-open section B of the side wall 6, front panel 3 and component 13 and a further cut-open section C of the cheek 31 of the carrier 28 permit a view of a limb 62 of a bearing bridge 63 which is fastened to the cover panel 17.

Studs 64, 65, 66 and 67 which are pressed into the cover plate 17 and disks which are pressed onto the latter and two of which are illustrated in FIG. 2 and are referred to by 68 and 69 are used for the fastening of the bearing bridge 63. The bearing bridge 63 is used, on the one hand, for mounting the thermal print head 48, the pivot axis of which is referred to by 70, and, on the other hand, for securing the feed roller 41 when the latter is in the printing position. In the insertion position of the carrier 28 that is illustrated in FIG. 2, the print head carrier 71 bears under the action of a spring (not illustrated) against a stop (likewise not illustrated) which is formed on the bearing bridge 63. In the printing position of the carrier 28 according to FIG. 3, the print head carrier 71 is raised against the cover panel 17 and the thermal element strip 72 which is fastened to the print head carrier 71 is in operative connection with the feed roller 41 and with the printing substrate 73 which is situated between the feed roller 41 and the thermal element strip 72 and runs off from the ribbon 29. It can furthermore be gathered from FIG. 2 that switches 74, bolts 75 and tabs 76 which are assigned to the latch elements 50, 51 are fitted or formed in pairs on the identically designed limbs 62 of the bearing bridge 63. In addition, retaining arms 79 which are assigned to the feed roller 41 and are provided with wedge surfaces 77 and snap-in lugs 78 are integrally formed on the limbs 62. Instead of the cylindrical bolts 75, fingers provided with a ramp may also be formed directly out of the limbs 62, which produces a greater security against shocks with a smaller outlay.

Figure 4:
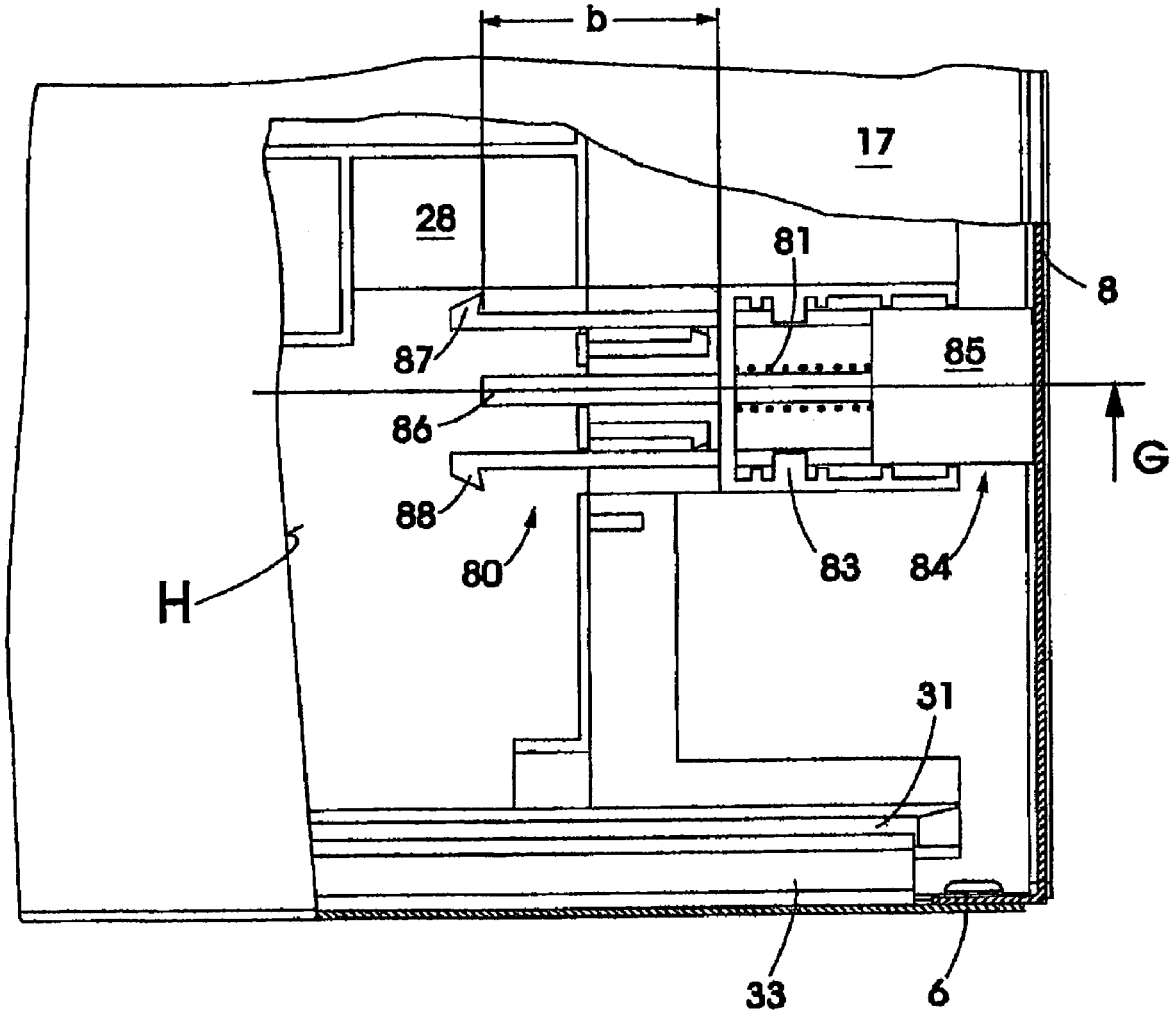
FIG. 4 shows a plan view of the push-in device, which is assigned to the carrier, in accordance with the arrow direction X in FIG. 1, with the cover plate cut open.

The shortened side view of FIG. 3 shows in the closed position of the carrier 28, in which the feed roller 41 or the bearing bushings 45 of the shaft 40 of the feed roller 41 are held on the retaining arms 79 of the bearing bridge 63, in which case the retaining arms 79 engage between the limbs 43, 44 of the framework 42 and the directing disks 46, 47 formed on the bearing bushings 45, firstly, by means of cut-open sections D of the side wall 6 and component 13 and also E of the front panel 3, the allocation of the structural elements situated in the carrier 28 to the structural elements arranged in a fixed position in the built-in housing part 2 in the closed position of the carrier 28, and, secondly, by means of a cut-open section F of the cover part 4, a section of the carrier 28 and of the push-in device 80 assigned to the latter, in accordance with the section line G in FIG. 4. It can be seen here that the latches 58 engage by means of the snap-in hooks 59 under the action of the tension spring 55 behind the bolts 75, which are provided in snap-in members, and at the same time are in operative connection to the switches 74. In addition, a compression spring 81 of the push-in device 80 acts on the snap-in hooks 59. FIG. 3 shows that, in the closed position of the carrier 28, there is a distance a between the sliding surfaces 61 of the actuating arms 60 and the tabs 76 serving as stops. A threaded stud which is attached to the rear wall 8 and is used for aligning the tachograph 1 when it is inserted is referred to by 82.

As can be gathered from FIG. 4, in particular from the cut-open section H in the cover panel 17, the push-in device 80 is arranged in a frame 83 of the carrier 28 which is chambered and has struts for stiffening purposes. That is, intersecting arms 87 and 88 are directly and integrally formed on a ram 84, which is used as a push-in member and has a ram head 85, and a shank 86 which supports the compression spring 81. The intersecting arms 87, 88 are guided in the frame 83 and are used, in conjunction with a wall (not referred to specifically) of the frame 83, through which they are guided, to limit the travel of the ram 84. The installation of the push-in device 80, which, by the ram head 85 being supported on the rear wall 8 of the tachograph 1 under the action of the compression spring 81, causes the carrier 28 to be displaced, after being unlocked, into a gripping position, takes place in a simple manner by the fact that, after the compressions spring 81 is placed onto the shank 86, the push-in device 80 is pushed into the frame 83 and secured on the carrier 28 by means of the intersecting arms 87, 88. Catch elements formed on the carrier 28 serve to secure the intercepting arms 87, 88 when the latter come into the retaining position during displacement of the carrier 28.

The functioning of the unlocking of the carrier 28 will be summarized once again in brief below. If it can be seen that printing material has to be refilled in the form of a new ribbon 29, then the carrier 28 is first of all unlocked by actuation of the pushbutton 38. When the pushbutton 38 is released, the push-in device 80 displaces the carrier into a gripping position. The carrier 28—the front panel 35 serving as a gripping element—can then be pulled out of the device into the insertion position which is determined by a suitable stop (not illustrated). After a new ribbon 29 is inserted, the carrier 28 can be pushed back into the device by applying pressure to the front panel 35, in which case the free end of the printing substrate 73 is drawn off from the ribbon 29 to such an extent that it overlaps at least the feed roller 41 before the latch elements 50, 51 are snapped into place and the feed roller 41 is brought into the printing position.

Specifically, there is the following sequence of functions when actuating the pushbutton 38 to unlock the carrier 28. First, by the pin 53 sliding along the sloping plane 54 of the pushbutton 38, the latch elements 50, 51, which are fastened on the common shaft 52, are pivoted in the arrow direction P counter to the action of the tension spring 55 and, as a result, the lock between the bolts 75 and the latching hooks 59 is released. After passing through the distance A, the actuating arms 60 strike against the tabs 76. In this case, owing to the different distance between the shaft 52 and the points at which the actuating arms 60 strike against the tabs 76, on the one hand, and between the shaft 52 and the pin 53, on the other hand, a two-armed lever is produced. The latter causes, by the sliding surfaces 61 of the actuating arms 60 being supported on the positionally fixed tabs 76 on further actuation of the pushbutton 38, the carrier 28 to be displaced by a deflectional force in the direction of the insertion position. At the same time, the bearing bushings 45 of the shaft 40 of the feed roller 41 are pushed over the snap-in lugs 78, this presupposing a certain amount of play between the guide rails 33, 34 and the cheeks 31, 32 of the carrier 28 or a certain pivotability of the feed roller 41 about the driving gearwheel of the drive mechanism, and the feed roller 41 is therefore brought out of frictional connection with the thermal print head 48.

In this situation, the push-in device 80, the entire travel of which is referred to by b in FIG. 4, acts in such a manner that the bottom (not illustrated) of a chamber, which is formed on the front wall 35, serves to guide the pushbutton 38 and through which a shank 91 of the pushbutton 38 reaches, strikes against the pushbutton 38, which is still being firmly held, and, when the pushbutton 38 is released, the carrier 28 is displaced into the gripping position, in which the intercepting arms 87, 88 bear against the frame 83. In contrast with the design of the pushbutton 38 selected in FIG. 2, the pushbutton 38 may also be designed unambiguously, i.e., provided with a shank 91 which has a flat profile and on which the sloping plane 54 is formed on the end side.

I claim:

1. A tachograph comprising:

a cubic housing;

a printing device having a thermal print head, a feed roller driven by a drive mechanism and a carrier movable out of the housing and adapted to reload a ribbon which forms a stock of printing material;

means for locking and unlocking the carrier in a closed position in the housing of the tachograph;

at least one latch element subjected to an action of a tension spring, wherein the latch element is mounted rotatably on the carrier;

a snap-in hook of the latch element associated with a snap-in member in a fixed position;

an actuating arm formed with the latch element;

a pushbutton configured to be in operative connection with the actuating arm and mounted displaceably on the carrier; and a fixed stop associated with the actuating arm and configured to disengage the latch element from the snap-in member when the pushbutton is actuated, and to displace the carrier in a direction of an insertion position when the actuating arm is supported on the stop.

2. The tachograph of claim 1, wherein the carrier has a latch element on a first side and a latch element on a second side, and wherein the latch elements are fastened on a shaft which is mounted in the carrier.

3. The tachograph of claim 2, further comprising a switch assigned to at least one latch element to indicate a closed position of the carrier.

4. The tachograph of claim 1, further comprising a pin fastened to the actuating arm, wherein the pushbutton is provided with a sloping plane which is assigned to the pin.

5. The tachograph of claim 1, wherein the carrier is provided on a front side with a gripping means.

6. The tachograph of claim 1, further comprising a push-in member arranged on the carrier, wherein the push-in member is spring-mounted and interacts with a rear wall of the tachograph.

7. The tachograph of claim 1, wherein the thermal print head is subjected to an action of a spring and mounted pivotably in a bearing bridge fastened to the cover plate of the built-in housing part of the tachograph, wherein the feed roller and the running mechanism are assigned to the carrier, wherein the feed roller is supported in the closed position of the carrier under the thermal print head, which rests resiliently on it, by retaining arms formed on the bearing bridge, wherein the snap-in members are assigned to the latch elements, and wherein stops are provided on limbs of the bearing bridge.

8. The tachograph of claim 7, wherein the feed roller comprises bearing bushings arranged in a framework of the drive mechanism, wherein snap-in lugs formed on the retaining arms are assigned to the bearing bushings, and wherein a guide of the carrier has a play corresponding to a travel of the snap-in lugs.

9. The tachograph of claim 7, wherein the snap-lugs are formed on the retaining arms, and wherein the feed roller is arranged pivotably in a framework of the feed mechanism concentrically with respect to a gearwheel driving it.

10. A tachograph comprising:

a cubic housing;

a printing device having a thermal print head, a feed roller driven by a drive mechanism, and a carrier movable out of the housing and configured to reload a ribbon which forms a stock of printing material, wherein the thermal print head is subjected to an action of a spring mounted pivotably in a bearing bridge fastened to a cover plate of a built-in housing part of the tachograph, wherein the feed roller and the drive mechanism are assigned to the carrier, wherein the feed roller is supported in a closed position of the carrier under the thermal print head, which rests resiliently on it, by retaining arms formed on the bearing bridge; and means for locking and unlocking the carrier in the closed position in the housing of the tachograph, wherein the feed roller comprises bearing bushings arranged in a framework of the drive mechanism, wherein the bearing bushings are assigned to holders formed on the retaining arms and configured to lock the carrier by means of the thermal print head resting on the feed roller, wherein unlocking elements are fastened on a shaft mounted rotatably in the carrier and subjected to an action of a tension spring, wherein a pushbutton is actively connected to one of the unlocking elements and mounted displaceably on the carrier, and wherein stops are assigned to the unlocking elements and formed on limbs of the bearing bridge so that a deflection of force causes the bearing bushings to be lifted out of the holders and the carrier to be displaced in a direction of an insertion position when the pushbutton is actuated.

* * * * *